US012680448B2

(12) United States Patent
Ahmad et al.

(10) Patent No.: US 12,680,448 B2
(45) Date of Patent: Jul. 14, 2026

(54) DATA SERVICES PLATFORM FOR MANAGING DATA PROCESSING MODELS AND REAL-TIME DATA FROM WELL SYSTEMS

(71) Applicant: Halliburton Energy Services, Inc., Houston, TX (US)

(72) Inventors: Fahad Ahmad, Houston, TX (US); Feng Feng, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 207 days.

(21) Appl. No.: 18/340,772

(22) Filed: Jun. 23, 2023

(65) Prior Publication Data

US 2024/0426209 A1 Dec. 26, 2024

(51) Int. Cl.
*E21B 47/12* (2012.01)

(52) U.S. Cl.
CPC ..... *E21B 47/12* (2013.01)

(58) Field of Classification Search
CPC ..... E21B 47/12; E21B 44/00
See application file for complete search history.

(56) References Cited

U.S. PATENT DOCUMENTS 10,878,379 B2 12/2020 Wing et al.
11,086,298 B2 8/2021 Chand et al.
11,126,635 B2 9/2021 Behzadi et al.
11,403,541 B2 * 8/2022 Thomsen ..... G06N 5/048
2012/0303326 A1 * 11/2012 Waid ..... H04L 67/12 702/188
2015/0006081 A1 * 1/2015 Versteeg ..... G01V 3/38 702/7

(Continued)

FOREIGN PATENT DOCUMENTS

EP 2222937 12/2014
EP 3462214 4/2019

OTHER PUBLICATIONS

"PCT Application No. PCT/US2023/069111, International Search Report and Written Opinion", Mar. 11, 2024, 9 pages.

*Primary Examiner* — Steven Lim
*Assistant Examiner* — Jerold B Murphy
(74) *Attorney, Agent, or Firm* — DeLizio, Peacock, Lewin and Guerra, LLP

(57) ABSTRACT

Systems, methods, and apparatus, including computer programs encoded on computer-readable media, for implementing a data services platform for real-time data obtained from well systems are disclosed. The data services platform may receive a first data processing algorithm for processing real-time data from one or more well systems. The first data processing algorithm may be created using a template associated with the data services platform. The data services platform may integrate the first data processing algorithm into a framework of the data services platform that provides a plurality of data management functions for managing the real-time data. The data services platform may receive a configuration for the first data processing algorithm that includes one or more parameters associated with the real-time data from at least a first well system, and may configure the framework that provides the plurality of data management functions with the one or more parameters.

19 Claims, 6 Drawing Sheets

(56) References Cited

U.S. PATENT DOCUMENTS

| | | | | |
|---|---|---|---|---|
| 2019/0066133 | A1 | 2/2019 | Cotton | |
| 2020/0149354 | A1 | 5/2020 | Singh et al. | |
| 2020/0327371 | A1* | 10/2020 | Sharma | H04L 67/34 |
| 2021/0332696 | A1 | 10/2021 | Wise et al. | |
| 2023/0169522 | A1 | 6/2023 | Narayanan et al. | |

* cited by examiner

DATA SERVICES PLATFORM FOR MANAGING DATA PROCESSING MODELS AND REAL-TIME DATA FROM WELL SYSTEMS

TECHNICAL FIELD

The present disclosure relates generally to energy services, and more specifically to a data services platform for managing data processing models and real-time data from well systems.

BACKGROUND

The Industrial Internet of Things (IIoT) can be used in various industrial operations, including upstream oil and gas, such as oil and gas exploration and production (E&P) operations. In oil and gas E&P operations, well systems may include a variety of IIoT sensors and other devices in surface well equipment and downhole well equipment that provide real-time data about the E&P operations, the well system devices, and well system conditions, among others. The real-time data can be received by a well system operator, by an edge network operator, and by a remote cloud network for processing and analysis. For example, the real-time data can be processed by applications to provide actionable insights regarding the well system. Developing, deploying and managing models and algorithms for various applications that process and analyze the real-time data can be costly, inefficient and time consuming.

DESCRIPTION

Figure 1:
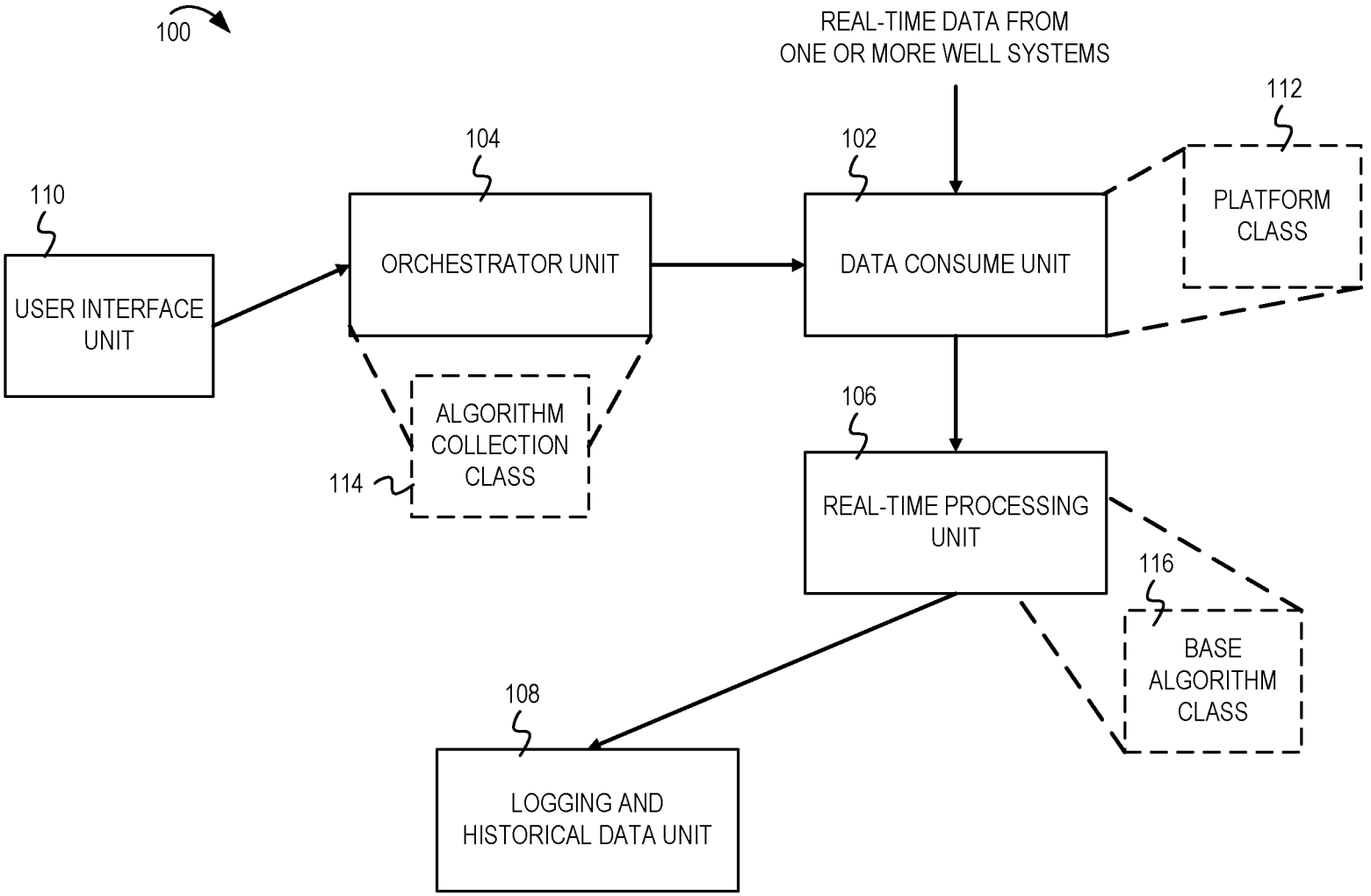
FIG. 1 depicts an example block diagram of a data services platform configured to develop, deploy and manage data processing algorithms and real-time data from one or more well systems, according to some implementations.

The description that follows includes example systems, methods, techniques, and program flows that describe aspects of the disclosure. However, it is understood that this disclosure may be practiced without these specific details. For instance, this disclosure refers to reservoir modeling in illustrative examples. Aspects of this disclosure can be instead applied to other types of models involving spatiotemporal datasets. In other instances, well-known instruction instances, protocols, structures, and techniques have not been shown in detail to avoid confusion.

Hydrocarbon services operations, such as oil and gas exploration and production (E&P) operations, utilize Industrial Internet of Things (IIoT) devices in well systems. The IIoT devices may include IIOT sensors and other devices that provide real-time data for the well systems to a local edge network operator and to remote cloud network. The real-time data may refer to both time-series data that is streamed in real-time and continuously or randomly sampled data that is streamed in real-time. Various applications in the edge network and in the remote cloud network can process and analyze the real-time data. Both the timeliness of the analysis and the accuracy of the analysis are of high value. Unlike batch processing, the developer of algorithms, modules, and business logic that ingests real-time data for applications may need to consider the tradeoff between data latency and data completeness. Having to implement the logic to handle both the latency and completeness can be repetitive and tedious if there are various algorithms that are built. Also, the developer of the algorithms may not have the expertise to handle the various types of algorithms.

In some cases, the real-time data from the same IIOT sensor or device can be re-sampled under different frequencies to fit different storage, transmission, or processing constraints. For example, raw data can be upsampled to be processed over the cloud network more efficiently. To account for re-sampling data or other changes to the data, algorithms may need to be rewritten to fit into the heterogeneity of the same data or developers may need to handle the data format repeatedly. As the real-time data begins to be used by multiple entities, users, platforms and applications, there may be common functionalities, processes or calculations in the algorithms that may be reused. Rewriting or copying the code for the algorithms to achieve the common functionalities, processes or calculations can be tedious, error-prone and difficult to maintain. However, being able to deploy, manage and reuse the code for the algorithms can provide value by saving time and ensuring results are consistent. The same algorithms cannot only differ across entities, users, equipment and environments, but can also evolve over time. Handling the numerous different versions of algorithms can be time consuming and difficult to manage.

Various innovative aspects of the subject matter described in this disclosure for implementing a data services platform configured to develop, deploy and manage data processing algorithms and real-time data from one or more well systems used in the oil and gas industry. The data services platform may receive an input of a first data processing algorithm having a data processing function for processing real-time data from one or more well systems. The first data processing algorithm may be created using a template associated with the data services platform. The data services platform may integrate the first data processing algorithm into a framework of the data services platform having a plurality of data management algorithms that provide a plurality of data management functions for managing the real-time data. The plurality of data management algorithms include a plurality of prebuilt and reusable algorithms that are ancillary to the first data processing algorithm and perform the plurality of data management functions (such as input and output (I/O) data management functions, version management functions, data visualization functions, etc.) for the data processing algorithm, as further described below. The data services platform may receive a configuration for the first data processing algorithm that includes one or more parameters associated with the real-time data from at least a first well system. The data services platform may configure the framework that provides the plurality of data management functions with the one or more parameters. The data services platform may identify and consume the real-time data from the first well system based on the one or more parameters, may process the real-time data, and may provide output data for visualization and analysis, among other features, as further described below.

Example Systems

FIG. 1 depicts an example block diagram of a data services platform 100 configured to develop, deploy and manage data processing algorithms and real-time data from one or more well systems. FIG. 1 shows an example of a high-level block diagram of an example data services platform 100 that can be implemented remotely in a cloud server network or locally in an edge network. In some implementations, the data services platform 100 may be implemented remotely from various well systems in one or more servers of a cloud server network. In some implementations, the data service platform 100 may be implemented locally at a local or edge network of one or more well systems. In some implementations, the data services platform 100 may include a data consume unit 102, an orchestrator unit 104, a real-time processing unit 106, a historical data unit 108, and a user interface unit 110. The data service platform 100 may be configured to develop, deploy and manage data processing algorithms and real-time data from well sensors (such as IIoT sensors), well equipment and other well devices of the one or more well systems. It is noted that the terms algorithms, models, and business logic may be used interchangeably herein in this disclosure. It is also noted that real-time data may include data measurements that are taken periodically (such as time-series data), data measurements that are taken continuously, and data measurements that are taken at random times (or as needed), and which are streamed or transmitted in real-time.

In some implementations, a developer or other user of the data service platform 100 may write, copy, upload or otherwise input an algorithm into a user interface of the data service platform 100. The algorithm may be created to perform a data processing function, such as processing real-time data from a well system, and thus the algorithm may be referred to as a data processing algorithm. The developer of the data processing algorithm may write, create, or build a first data processing algorithm based on a base algorithm class 116 that is supported by the data service platform 100. In some implementations, the base algorithm class 116 can be implemented by the real-time processing unit 106. Various prebuilt and reusable algorithms that are part of the framework of the data services platform 100 are encapsulated using the base algorithm class 106. The various prebuilt algorithms provide various data management functions, such as input and output (I/O) functions, authentication functions, version management functions, and visualization functions, among others, and thus may also be referred to as data management algorithms, as further described below. In some implementations, the developer may build the first data processing algorithm based on a specific template of the data services platform 100, such as the base algorithm class 116 or a subclass of the base algorithm class 116. By building the first data processing algorithm using template or a subclass of the base algorithm class 116, once the first data processing algorithm is input into the data services platform 100, the first data processing algorithm can be seamlessly integrated into the framework that provides the prebuilt and reusable modules that handle data management functions, as further described below. Once the first data processing algorithm is integrated into the framework of the data services platform 100, the first data processing algorithm is integrated with the prebuilt algorithms that provide the additional data management functions. In some implementations, the prebuilt and reusable algorithms that provide data management functions can be implemented in a middle layer that provides the framework for the data services platform 100 and which can be used by algorithms that are input into the data services platform 100.

Figure 2:
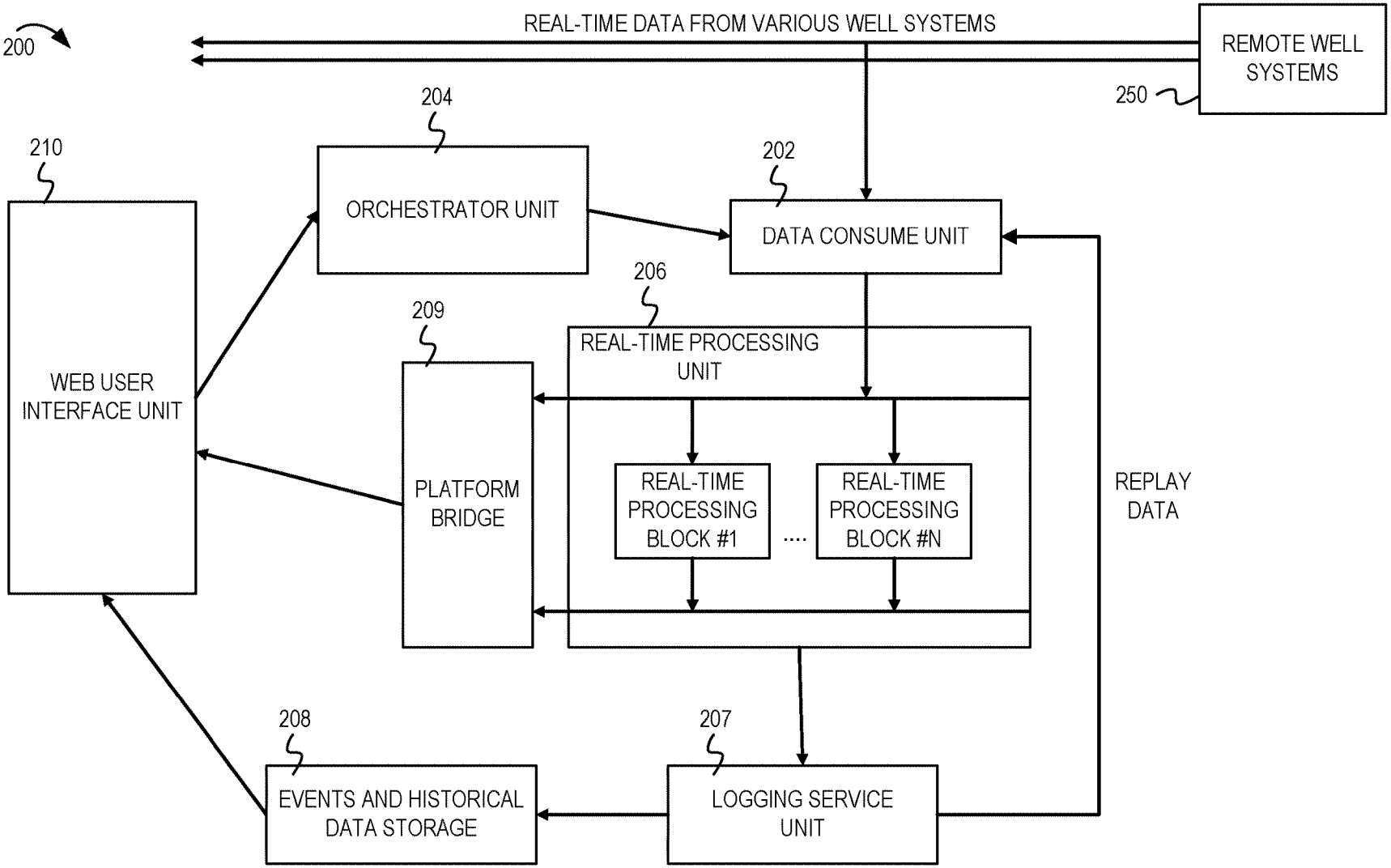
FIG. 2 depicts an example block diagram of a data services platform that may be implemented in a cloud server network and configured to develop, deploy and manage data processing algorithms and real-time data from various well systems, according to some implementations.

In some implementations, the real-time processing unit 106 of the data services platform 100 receives or detects the input of the first data processing algorithm and stores the first data processing algorithm. As noted above, in some implementations, the developer or user of the data services platform 100 may create the first data processing algorithm using a subclass of the base algorithm class 116 that is supported by the data service platform 100 and implemented in the real-time processing unit 106. The real-time processing unit 106 may integrate the first data processing algorithm into the framework of the data service platform 100. For example, the real-time processing unit 106 may access the middle layer having the prebuilt algorithms that provide additional data management functions and add the prebuilt algorithms to the first data processing algorithm that was input by the user. By integrating the first data processing algorithm with the framework of the data services platform 100 that provides additional data management functions, the developer or user of the data services platform 100 does not have to add additional code or algorithms for the data management functions (such as I/O functions and visualization functions). The prebuilt algorithms can be seamlessly integrated and reused with many data processing algorithms that are input into the data services platform 100. In some implementations, the base algorithm class 116 may provide a base implementation of the data processing algorithms and also provide an abstraction (such as through the prebuilt algorithms in a middle layer) that may be needed by each data processing algorithm for the additional data management functions, such as I/O functions including accepting new data points, maintaining a sliding time window, and cool down mechanisms, among others. In some implementations, for each data processing algorithm that is input into the data services platform 100, the real-time processing unit 106 may create a separate real-time processing instance or block or process (as shown in FIG. 2) that is customized for each data processing algorithm and which individually and separately integrates each data processing algorithm to the framework of the data services platform 100.

In some implementations, the orchestrator unit 104 may receive a configuration for the first data processing algorithm from a developer or other user of the data services platform 100 and set the configuration for the first data processing algorithm in the data services platform 100. For example, the developer or user of the data services platform 100 may input the configuration for the data processing function of the first data processing algorithm, such as a configuration for a job or process involving the first data processing algorithm, via a user interface (such as the user interface unit 110) either at an edge network or at a cloud server network. In some implementations, the configuration may include a parameter that identifies the well system and parameters that are associated with the real-time data that is received from a first well system. For example, the parameter that identifies the well system may be a well identifier (ID) or well ID number. The parameters that are associated with the real-time data may include a sliding time window size for the real-time data and one or more well system parameters included in the real-time data that will be processed by the first data processing algorithm. For example, the sliding time window size may indicate the first data processing algorithm will process a sliding time window size of a certain number of seconds, minutes, or hours, such as a sliding time window size of 30 seconds or 2 minutes. As another example, the one or more well system parameters that are part of the real-time data from a well system (such as the first well system associated with the first data processing algorithm) may include readings from one or more well sensors or other well devices, such as a flow rate parameter, a temperature parameter, a pressure parameter, a stuck pipe parameter, and various other well system parameters that may be processed and monitored using the data services platform 100. In some implementations, the orchestrator unit 104 may provide the configuration to the data consume unit 102, as further described below. In some implementations, the orchestrator unit 104 may keep track of all the various active data processing algorithms that have been integrated into the framework of the data services platform 100 and stored in the real-time processing unit 106. For example, the orchestrator unit 104 may implement an algorithm collection class that stores a list of active data processing algorithms, and allows the addition of new algorithms and removal of existing algorithms. The orchestrator unit 104 also may keep track of the configurations for the various data processing algorithms.

In some implementations, the data consume unit 102 receives a configuration for the first data processing algorithm (and for other data processing algorithms) from the orchestrator unit 104. In some implementations, when the data services platform 100 is implemented locally in a local or edge network that is local to a single well system, the data consume unit 102 may receive real-time data from only the single well system. When the data services platform 100 is implemented locally in a local or edge network that is local to multiple well system, the data consume unit 102 may receive real-time data from only the multiple single well system, such as 3 well systems or 5 well systems that are accessible to the edge network. In some implementations, when the data services platform 100 is implemented in a cloud server network that is remote to various well systems, the data consume unit 102 may receive real-time data from the various well systems that may be located in various regions of a country or in different countries (as further described in FIG. 2). Whether the data consume unit 102 receives multiple streams or transmissions of real-time data from multiple well systems or a single stream or transmission from a single well system, the data consume unit 102 may detect and consume the real-time data that matches the configuration associated with the first data processing algorithm. For example, the data consume unit 102 may detect the real-time data from a specific well system (such as well ID #100), may consume data in a certain sliding time window size specified by the configuration (such as a 30 second sliding time window), and may consume one or more well system parameters specified by the configuration (such as a stuck pipe parameter and a pressure parameter). The data consume unit 102 may provide the consumed real-time data, such as the one or more well system parameters, to the real-time processing unit 106 for processing using the first data processing algorithm (i.e., perform the data processing function associated with the first data processing algorithm). Thus, the data consume unit 102 may ensure that the correct real-time data is provided to the right data processing algorithm in the right real-time processing instance or process. In some implementations, the data consume unit 102 may implement a platform class 112, which may be an abstraction class that interacts with real-time data platforms, including an application programming interface (API) for a real-time data streaming service that provides real-time data from multiple well systems to the data services platform 100 that can be implemented remotely in a cloud server network, or an API for a local real-time data streaming service that streams real-time data from one or more local well systems to the data services platform 100 that can be implemented locally in an edge network.

In some implementations, the orchestrator unit 104 can start the execution of a job or a process associated with a configuration for the first data processing algorithm. The orchestrator unit 104 may manage different jobs or processes for various data processing algorithms. In some implementations, each data processing algorithm, such as the first data processing algorithm, may have different configurations associated with different jobs or processes. When the orchestrator unit 104 starts a job or a process associated with a configuration for the first data processing algorithm (such as by communicating with the data consume unit 102), the data consume unit 102 begins detecting and consuming the real-time data associated with the configuration (such as the well system parameters). The data consume unit 102 provides the real-time data to the real-time processing unit 106 for processing using the first data processing algorithm. The real-time processing unit 106 may provide the output of the first data processing algorithm to the logging and historical data unit 108. The logging and historical data unit 108 may provide data management functions (such as via one or more prebuilt algorithms) to analyze and visualize the output results from the first data processing unit. For example, the logging and historical data unit 108 may plot real-time graphs of the output data from the first data processing algorithm, such as real-time graphs of the processed well system parameters. The logging and historical data unit 108 may determine and predict trends in the output data and may trigger alerts and other notifications that can be provided to the user or operator of the data services platform 100. For example, the logging and historical data unit 108 may work in conjunction with the user interface unit 110 to provide a dashboard for visualizing the output data in real-time (such as various graphs and charts) and providing real-time alerts to the platform user. The logging and historical data unit 108 also may store the output data in order to build a store of historical data that can be accessible for future training, testing, or development. For example, the user of the data services platform 100 may request the stored problems that were detected or the alerts that were provided the past seven days, and the logging and historical data unit 108 may provide the stored data to the dashboard of the user. In some implementations, the alerts, notifications, and other output data that the data services platform 100 provides to the operators of the well systems may be used for troubleshooting the well system, modifying the operations of the well system (such as modifying the drilling operation), modifying the design of the well system (such as replacing or removing one or more well devices), and performing maintenance of the well system.

In some implementations, the logging and historical data unit 108 may work in conjunction with the data consume unit 102 to provide a replay of historical data as if the data was being detected and consumed by the data services platform 100 in real-time (or live data). In some implementations, after receiving a request from user to replay historical data, the logging and historical data unit 108 may provide the historical data to the data consume unit 102, and the data consume nit 102 may detect and consume the historical data as if it's real-time data. The rest of the processing of the historical data may also be as if it's real-time data. For example, the data consume unit 102 may provide the historical data to the real-time processing unit 106 for processing using a data processing algorithm (such as the first data processing algorithm). The real-time processing algorithm 106 may provide the processed data to the logging and historical data unit 108 in order to visualize and analyze the data. For example, the replayed data may be visualized and analyzed in a user's dashboard using graphs, charts, and other analysis and visualization tools.

Based on the operations, features, and components of the data service platform 100 described herein in this disclosure, the data service platform 100 may allow real-time data ingestion, processing, and visualization at both a local edge network and a remote cloud server network. The data services platform 100 may allow the decoupling of software development and algorithm development. In some implementations, the data services platform 100 may allow test and evaluation of data processing algorithms, or to change existing data processing algorithms that work with batch processing to be compatible and work with data streaming processing without having to rewrite the algorithms to handle the intricacies related to the data management functions, such as the I/O data management, the data format from various data sources, the algorithm version differences (and which version is operating on which data stream), the authentication of deployed algorithms, and the export and visualization of the output from the data processing algorithm, among others. In some implementations, the data services platform 100 may containerize the data management algorithms that are provided by the framework of the data services platform 100 as prebuilt and reusable data management algorithms. When the data processing algorithm is integrated into the data services platform 100, the prebuilt and reusable data management algorithms can be combined with, or be accessible by, the data processing algorithm to develop application within the data services platform 100. The applications can be implemented in the data services platform 100 and can be deployed in both a local edge network and in a cloud server network. By providing the developer or user of the data services platform 100 the prebuilt and reusable data management algorithms, the developer or user may only need to develop and build an algorithm once and without having to code the ancillary data management functions that are provided by the prebuilt algorithms.

The data services platform 100 may oil and gas service companies to provide customized IIOT related solutions to clients. The clients themselves can also utilize the data services platform 100 to develop their own data processing algorithms, models and business logic that consumes streaming, real-time data. The data services platform 100 can help oil and gas services companies to accelerate the development of data processing algorithms, models, and business logic and thus generate more value for their clients. The data services platform 100 may allow oil and gas services companies to reduce the cost of maintaining and managing the data processing algorithms which can be improved iteratively over time. Oil and gas services companies that have different product service lines that can utilize the data services platform 100 may create synergies between product service lines, and thus may allow the oil and gas services companies to offer unique solutions for their clients. The data services platform 100 may be customized for the oil and gas services industry and provide a complete end-to-end solution for operators in the oil and gas services industry.

In some implementations, the well systems may be any type of well system in the oil and gas industry, such as well systems that are used in oil and gas E&P operations. One example of a well system may be a drilling rig system that is used for drilling, exploration, and production operations, which is further described in FIG. 5. Another example of a well system may be a fracturing system that is used for fracturing operations, which is further described in FIG. 6. It is noted, however, that the well systems may be any time of drilling well systems, completion well systems, and producing well systems, including both naturally flowing or artificially lifted well systems.

FIG. 2 depicts an example block diagram of a data services platform 200 that may be implemented in a cloud server network and configured to develop, deploy and manage data processing algorithms and real-time data from various well systems 250. The data service platform 200 shown in FIG. 2 may be one example implementation of the high-level diagram of the data service platform 100 of FIG. 1. In some implementations, the data services platform 200 may be implemented remotely from the well systems 250 in one or more servers of a cloud server network. The various well systems 250 may be located remotely anywhere in the world, such as in multiple regions of a country or in multiple countries. In some implementations, the data services platform 200 may include a data consume unit 202, an orchestrator unit 204, a real-time processing unit 206, a logging service unit 207, an events and historical data storage 208, a platform bridge 209, and a web user interface unit 210. The real-time processing unit 206 may include a plurality of real-time processing instances or blocks, such as the real-time processing blocks #1 through #N, where N is any positive integer greater than 1. The data service platform 200 may be configured to develop, deploy and manage various data processing algorithms and various real-time data streams from the well systems 250. It is noted that the terms algorithms, models, and business logic may be used interchangeably herein in this disclosure. It is also noted that real-time data may include data measurements that are taken periodically (such as time-series data), data measurements that are taken continuously, and data measurements that are taken at random times (or as needed), and which are streamed or transmitted in real-time.

In some implementations, a developer or other user of the data service platform 200 may write, copy, upload or otherwise input a first data processing algorithm into a user interface of the data service platform 200, such as the web user interface unit 210. The developer or user may write, create, or build the first data processing algorithm based on a base algorithm class that is supported by the data service platform 200 (such as the base algorithm class 116 shown in FIG. 1). Various prebuilt and reusable algorithms that are part of the framework of the data services platform 200 are encapsulated using the base algorithm class. The various prebuilt algorithms provide various data management functions, such as I/O functions, authentication functions, version management functions, and visualization functions, among others, and thus may also be referred to as data management algorithms, as further described below. In some implementations, the developer may build the first data processing algorithm based on a specific template of the data services platform 200, such as the base algorithm class or a subclass of the base algorithm class supported by the data services platform 200. Once the first data processing algorithm is integrated into the framework of the data services platform 200, the first data processing algorithm is integrated with the prebuilt and reusable algorithms that provide the additional data management functions. In some implementations, the prebuilt and reusable algorithms that provide data management functions can be implemented in a middle layer that provides the framework for the data services platform 200 and which can be used by algorithms that are input into the data services platform 200.

In some implementations, the real-time processing unit 206 of the data services platform 200 receives or detects the input of the first data processing algorithm and stores the first data processing algorithm. The real-time processing unit 206 of the data services platform 200 may also receive or detect the input of a second data processing algorithm and store the second data processing algorithm. The second data processing algorithm may be input by the same or a different developer or user of the data service platform 200. As noted above, in some implementations, the first and second data processing algorithms may be created using a subclass of the base algorithm class (such as the base algorithm class 116 shown in FIG. 1) that is supported by the data service platform 200 and implemented in the real-time processing unit 206. In some implementations, the first data processing algorithm may be implemented by the real-time processing block #1 of the real-time processing unit 206, and the second data processing algorithm may be implemented by a different real-time processing block, such as a real-time processing block #2 or real-time processing block #N. The real-time processing block #1 may integrate the first data processing algorithm into the framework of the data service platform 200, and the real-time processing block #N may integrate the second data processing algorithm into the framework of the data service platform 200. For example, the real-time processing block #1 may access the middle layer having the prebuilt and reusable algorithms that provide additional data management functions and add the prebuilt and reusable algorithms to the first data processing algorithm that was input by the user. By integrating the first and second data processing algorithms with the framework of the data services platform 200 that provides additional data management functions, the developers or users of the data services platform 200 do not have to add additional code or algorithms for the data management functions (such as I/O functions and visualization functions). Similar to the description of FIG. 1, the prebuilt and reusable algorithms can be seamlessly integrated and reused with many data processing algorithms that are input into the data services platform 200.

In some implementations, the orchestrator unit 204 may receive different configurations for the first and second data processing algorithms and may set the configuration for the first and second data processing algorithms in the data services platform 200. For example, the developer or user of the data services platform 200 may input the configuration for the data processing function of the first data processing algorithm, such as a configuration for a job or process involving the first data processing algorithm, via a user interface (such as the web user interface unit 210) at a cloud server network. In some implementations, the configuration for each of the first and second data processing algorithms may include a parameter that identifies the well system and parameters that are associated with the real-time data that is received from a corresponding well system. For example, a first parameter for the first data processing algorithm may identify a well ID #50 at a first location, and a second parameter for the second data processing algorithm may identify a well ID #121 at a second location different from the first location. For each of the first and second data processing algorithms, the parameters that are associated with the real-time data may include a sliding time window size for the real-time data and one or more well system parameters included in the real-time data that will be processed by the corresponding data processing algorithm. For example, the sliding time window size may indicate the first data processing algorithm will process a sliding time window size of a certain number of seconds, minutes, or hours, such as a sliding time window size of 30 seconds or 2 minutes. As another example, for each of the first and second data processing algorithms, the one or more well system parameters that are part of the real-time data from a well system (such as a first well system for the first data processing algorithm and a second well system for the second data processing algorithm) may include readings from one or more well sensors or other well devices, such as a flow rate parameter, a temperature parameter, a pressure parameter, a stuck pipe parameter, and various other well system parameters that may be processed and monitored using the data services platform 200. In some implementations, the orchestrator unit 204 may provide the configuration of each of the first and second data processing algorithms to the data consume unit 202, as further described below. In some implementations, the orchestrator unit 204 may keep track of all the various active data processing algorithms that have been integrated into the framework of the data services platform 200 and stored in the real-time processing unit 206. For example, the orchestrator unit 204 may implement an algorithm collection class that stores a list of active data processing algorithms, and allows the addition of new algorithms and removal of existing algorithms. The orchestrator unit 204 also may keep track of the configurations for the various data processing algorithms.

In some implementations, the data consume unit 202 receives a first configuration for the first data processing algorithm and a second configuration for the second data processing algorithm (and also for any other data processing algorithms) from the orchestrator unit 204. In some implementations, the data consume unit 202 may receive real-time data from the various well systems 250 that may be located remotely in various regions of a country or in different countries. The data consume unit 202 may detect and consume the real-time data that matches the configurations associated with the first and second data processing algorithms. For example, the data consume unit 102 may detect the real-time data from well system ID #50, may consume data in a certain sliding time window size specified by the first configuration of the first data processing algorithm (such as a 30 second sliding time window), and may consume one or more well system parameters specified by the first configuration (such as a stuck pipe parameter and a pressure parameter). As another example, the data consume unit 202 may detect the real-time data from well system ID #121, may consume data in a certain sliding time window size specified by the second configuration of the second data processing algorithm (such as a 2-minute sliding time window), and may consume one or more well system parameters specified by the second configuration (such as a stuck pipe parameter and a flow rate parameter). The data consume unit 202 may provide the consumed real-time data, such as the one or more well system parameters specified in the first configuration, to the real-time processing block #1 for processing using the first data processing algorithm. The data consume unit 202 may provide the consumed real-time data, such as the one or more well system parameters specified in the second configuration, to the real-time processing block #N for processing using the second data processing algorithm. Thus, the data consume unit 202 may ensure that the correct real-time data is provided to the right data processing algorithm in the right real-time processing block of the real-time processing unit 206. In some implementations, the data consume unit 202 may implement a platform class (such as the platform class 112 shown in FIG. 1), which may be an abstraction class that interacts with real-time data platforms, including an application programming interface (API) for a real-time data streaming service that provides real-time data from the multiple well systems 250 to the data services platform 200.

In some implementations, the orchestrator unit 204 can start the execution of a first job or a first process associated with the first configuration for the first data processing algorithm, and start the execution of a second job or a second process associated with the second configuration for the second data processing algorithm. The orchestrator unit 204 may manage different jobs or processes for various data processing algorithms. When the orchestrator unit 204 starts the first job or the first process associated with the first configuration for the first data processing algorithm (such as by communicating with the data consume unit 202), the data consume unit 202 begins detecting and consuming the real-time data associated with the first configuration (such as the well system parameters). As described above, the data consume unit 202 provides the real-time data to the real-time processing unit 206 for processing using the first data processing algorithm. The real-time processing unit 206 may provide the output of the first data processing algorithm to the logging service unit 207 and to the web user interface 210. In some implementations, the real-time processing unit 206 (e.g., the real-time processing block #1) may provide the output to the web user interface 210 via the platform bridge 209. In some implementations, the logging service unit 207 may provide data management functions (such as via one or more prebuilt algorithms) to record, analyze and visualize the output results from the first data processing algorithm and the second data processing algorithm (and any other data processing algorithms). For example, the logging service unit 207 may store the historical data and other events data (such as alerts) in the events and historical data storage 208. The logging service unit 207 may work in conjunction with the events and historical data storage 208 to provide historical data (such as to the web user interface 210) that can be used to plot real-time graphs of the output data from one or more data processing algorithm, such as real-time graphs of the processed well system parameters. The logging service unit 207 may determine and predict trends in the output data and may trigger alerts and other notifications that can be provided to the user or operator of the data services platform 200. For example, the logging service unit 207 may work in conjunction with the web user interface unit 210 to provide a dashboard for visualizing the output data in real-time (such as various graphs and charts) and providing real-time alerts to the platform user. The logging service unit 207 also may store the output data and event history (such as alerts history) in the events and historical data storage 208 to build a store of historical data that can be accessible for future training, testing, or development. For example, the user of the data services platform 200 may request the stored problems that were detected or the alerts that were provided the past seven days, and the logging service unit 207 may provide the stored data to the dashboard of the user.

In some implementations, the logging service unit 207 may work in conjunction with the data consume unit 202 to provide a replay of historical data as if the data was being detected and consumed by the data services platform 200 in real-time (or live data). In some implementations, after receiving a request from user to replay historical data, the logging service unit 207 may provide the historical data (which may be referred to as the replay data or replayed historical data) to the data consume unit 202, and the data consume nit 202 may detect and consume the historical data as if it's real-time data. The rest of the processing of the historical data may also be as if it's real-time data. For example, the data consume unit 202 may provide the replayed historical data to the real-time processing unit 206 for processing using a data processing algorithm (such as the first data processing algorithm). The real-time processing algorithm 206 may provide the processed replay data to the logging service unit 207 and to the web user interface unit 210 in order to visualize and analyze the data. For example, the replayed historical data may be visualized and analyzed in a user's dashboard using graphs, charts, and other analysis and visualization tools.

Example Operations

Figure 3:
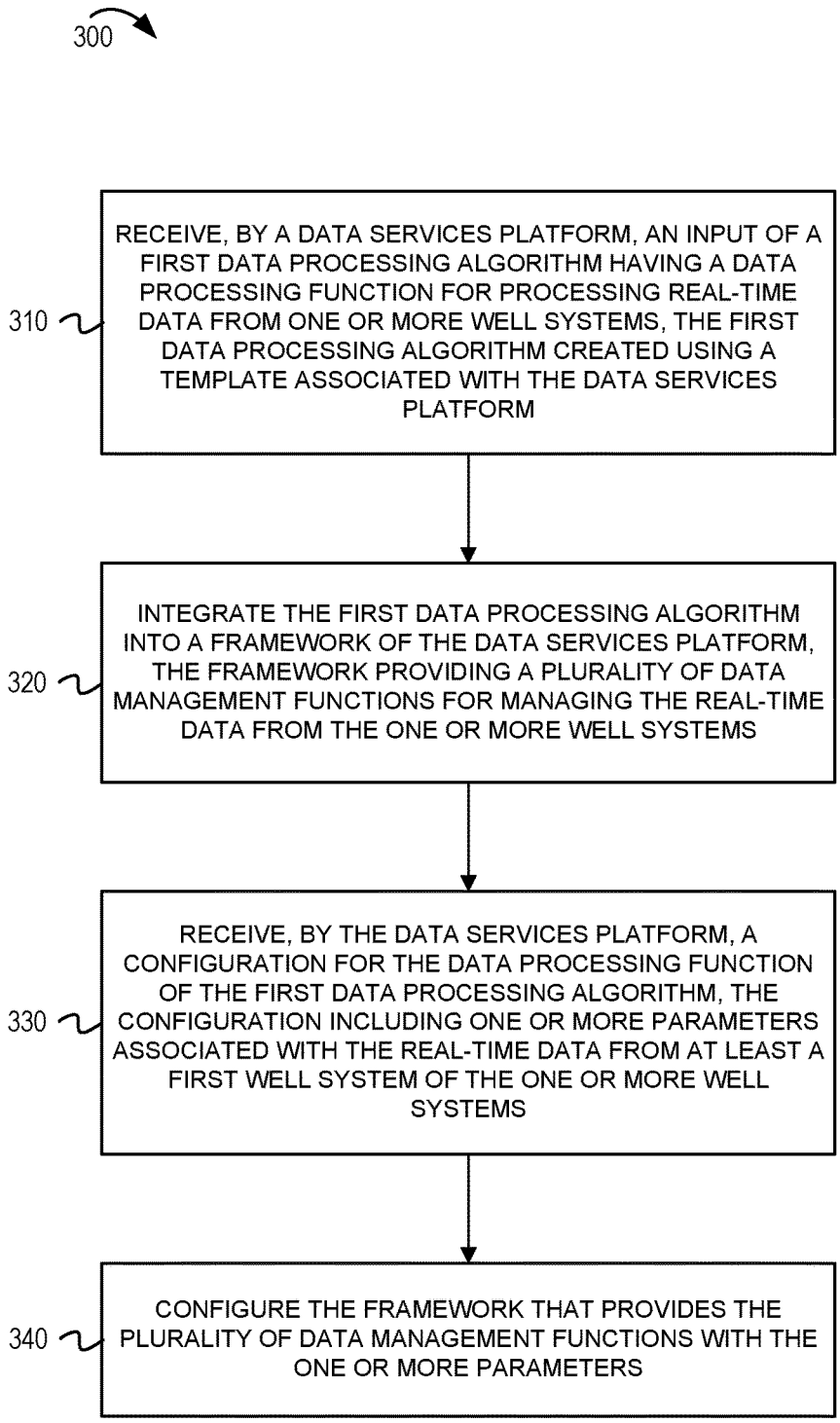
FIG. 3 is a flowchart of example operations for implementing a data services platform for real-time data obtained from well systems, according to some implementations.

FIG. 3 is a flowchart 300 of example operations for implementing a data services platform for real-time data obtained from well systems. Operations of the flowchart 300 are described in reference to the data services platforms of FIGS. 1, 2 and 4. The operations may include receiving, by the data services platform, an input of a first data processing algorithm having a data processing function for processing real-time data from one or more well systems. The first data processing algorithm may be created using a template associated with the data services platform (block 310). The operations may include integrating the first data processing algorithm into a framework of the data services platform. The framework may provide a plurality of data management functions for managing the real-time data from the one or more well systems (block 320). The operations may include receiving, by the data services platform, a configuration for the data processing function of the first data processing algorithm. The configuration may include one or more parameters associated with the real-time data from at least a first well system of the one or more well systems (block 330). The operations may include configuring the framework that provides the plurality of data management functions with the one or more parameters (block 330).

In some implementations, the operations of integrating the first data processing algorithm into the framework of the data services platform may include integrating the first data processing algorithm with a plurality of data management algorithms that provide the plurality of data management functions. The plurality of data management algorithms may be accessible by the first data processing algorithm during an execution of the first data processing algorithm and the processing of the real-time data from the first well system. In some implementations, the plurality of data management algorithms may include a plurality of prebuilt and reusable algorithms that are ancillary to the first data processing algorithm and perform the plurality of data management functions for the data processing algorithm. The data management functions may include at least one of I/O data management functions, algorithm authentication functions, algorithm version management functions, algorithm test and evaluation functions, data visualization and analysis functions, and historical data replay functions, among others.

In some implementations, one of the plurality of data management functions provided by the framework of the data services platform may include an input data management function for real-time data streams from a plurality of well systems. In some implementations, the operations may further include deploying and enabling the first data processing algorithm that utilizes the framework of the data services platform to perform the plurality of data management functions, and monitoring the real-time data streams from the plurality of well systems to select the real-time data from the first well system having the one or more parameters for processing by the first data processing algorithm. In some implementations, the plurality of data management functions provided by the framework of the data services platform may include an output data management function and a data visualization and analysis function for managing output data from the first data processing algorithm. In some implementations, the operations may further include detecting and storing the output data from the first data processing algorithm for storing historical data, and processing the output data for visualization and analysis of the output data. In some implementations, the operations of processing the output data for visualization and analysis of the output data from the first data processing algorithm may include providing alerts or notifications regarding the first well system to cause modification of well system operations or maintenance of the first well system.

In some implementations, the plurality of data management functions provided by the framework of the data services platform may include an output data management function and a historical data replay function. In some implementations, the operations may include detecting and storing the output data from the first data processing algorithm for storing historical data, receiving a request to replay historical data from a first time period, and replaying the historical data from the first time period in the data services platform as if the historical data is real-time data.

Example Computer

Figure 4:
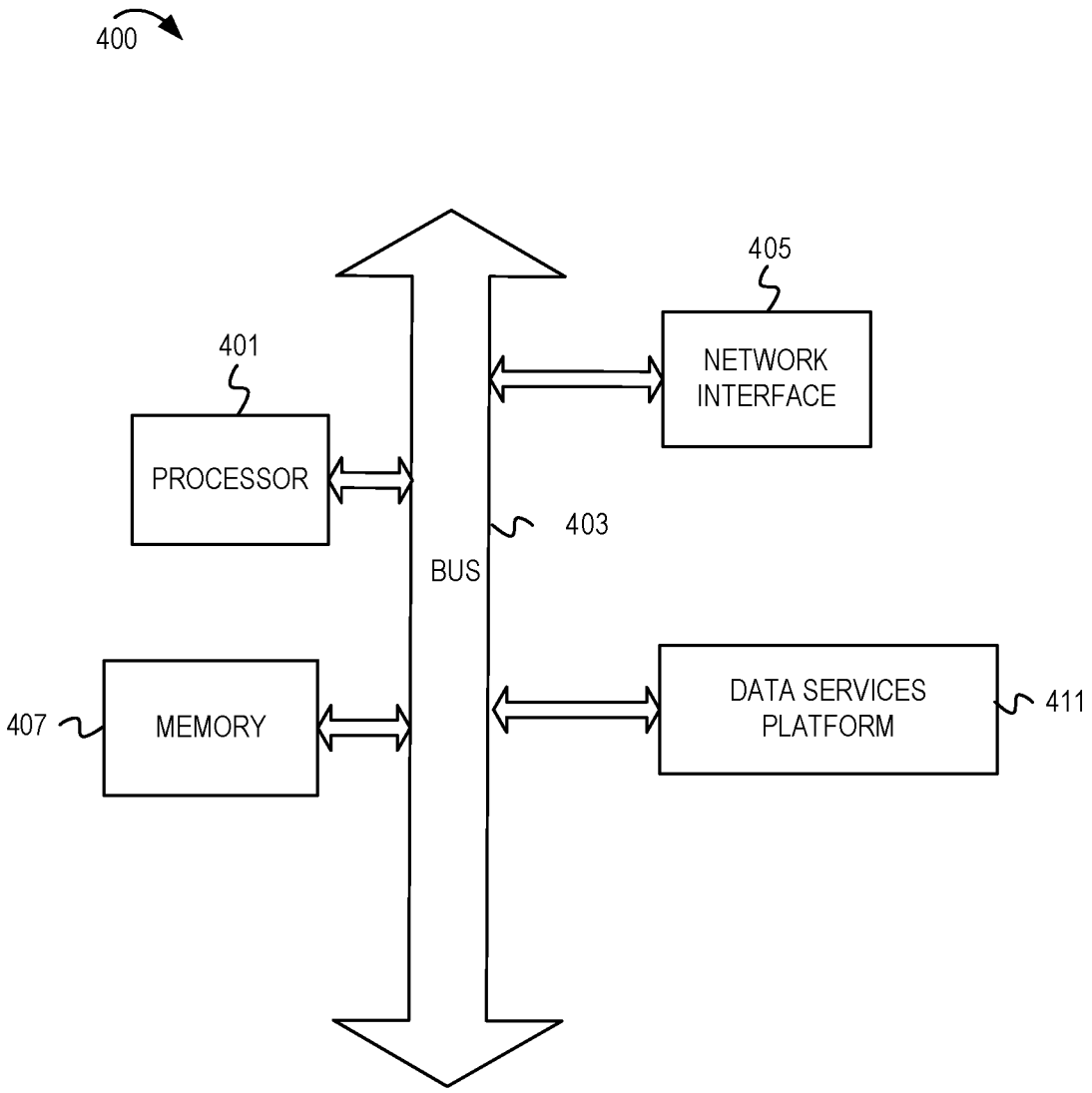
FIG. 4 depicts an example computer system configured to implement the data services platform, according to some implementations.

FIG. 4 depicts an example computer system 400 configured to implement the data services platform. For example, the computer system 400 may implement the data services platform 100 described in FIG. 1 or the data services platform 200 described in FIG. 2. In some implementations, the computer system 400 may be an example computer system or server or workstation at a local edge network. In some implementations, the computer system 400 also may be an example server in a remote cloud server network. In some implementations, although a single computer system is shown, the computer system 400 may be representative of multiple servers in the remote cloud server network that implements the data services platform. It is noted, however, that the computer system 400 may be any type of computer system that can be used in well systems. The computer system 400 may include one or more processors 401 (possibly including multiple cores, multiple nodes, and/or implementing multi-threading, etc.). The computer system 400 may include memory 407. The memory 407 may be system memory or any type or implementation of machine or computer readable media having instructions that are executable by the one or more processors 401 to implement the operations described in FIGS. 1-3. The computer system 400 also may include a bus 403 and a network interface 405. The computer system 400 also may implement a data services platform 411 that performs operations described in FIGS. 1-3. The data services platform 411 may represent either the data services platform 100 described in FIG. 1 or the data services platform 200 described in FIG. 2. The functionality described herein may be implemented with an application-specific integrated circuit, in logic implemented in the processor unit 401, in a co-processor on a peripheral device or card, etc. Further, implementations may include fewer or additional components not illustrated in FIG. 4 (e.g., video cards, audio cards, additional network interfaces, peripheral devices, etc.). The processor unit 401 and the network interface 405 may be coupled to the bus 403. Although illustrated as being coupled to the bus 403, the memory 407 may be coupled to the processor unit 401.

Example Well Systems

Figure 5:
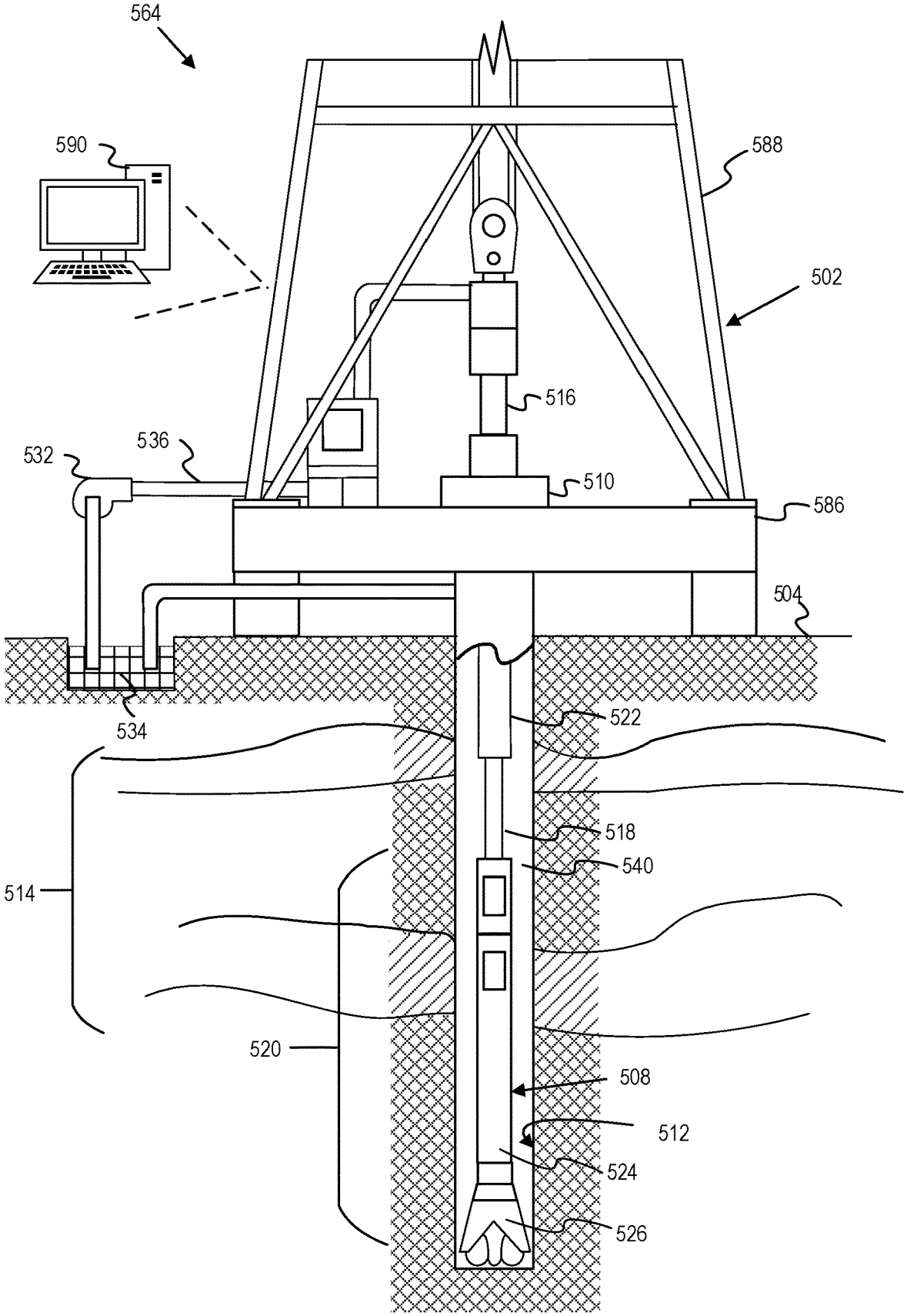
FIG. 5 is a schematic diagram of a drilling rig system as an example of a well system that can provide real-time data to a data services platform, according to some implementations.

FIG. 5 is a schematic diagram of a drilling rig system as an example of a well system that can provide real-time data to a data services platform. For example, in FIG. 5 it can be seen how a system 564 may also form a portion of a drilling rig 502 located at the surface 504 of a well. Drilling of oil and gas wells is commonly carried out using a string of drill pipes connected together so as to form a drilling string 508 that may be lowered through a rotary table 510 into a wellbore or borehole 512. Here a drilling platform 586 may be equipped with a derrick 588 that supports a hoist. A computer system 590 may be communicatively coupled to any sensors and control devices attached to surface equipment or the downhole equipment of the system 564. The computer system 590 may provide real-time data from the sensors and control devices to a data service platform that is implemented in a local edge network or a remote cloud server network, as described in FIGS. 1-4. The data service platform may provide alerts and other notifications or results data to the operator of the system 564 or the computer system 590 that can cause modification of the system operation or the maintenance of the system 564.

The drilling rig 502 may thus provide support for the drill string 508. The drill string 508 may operate to penetrate the rotary table 510 for drilling the borehole 512 through subsurface formations 514. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create a borehole 512 by penetrating the surface 504 and subsurface formations 514. The down hole tool 524 may comprise any of a number of different types of tools including MWD tools, LWD tools, and others.

During drilling operations, the drill string 508 (perhaps including the Kelly 516, the drill pipe 518, and the bottom hole assembly 520) may be rotated by the rotary table 510. In addition to, or alternatively, the bottom hole assembly 520 may also be rotated by a motor (e.g., a mud motor) that may be located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 514.

Drilling operations may utilize various surface equipment, such as a mud pump 532 or other types of surface equipment. The surface equipment may be outfitted with one or more sensors and one or more control devices, as described herein. During drilling operations, the mud pump 532 may pump drilling fluid (sometimes known by those of ordinary skill in the art as "drilling mud") from a mud pit 534 through a hose 536 into the drill pipe 518 and down to the drill bit 526. In some implementations, one or more sensors may monitor one or more metrics of the pump drilling fluid (such as flow rate), and one or more control devices may control one or more operations of the mud pump 532 (such as opening and closing one or more valves or other mechanisms). The drilling fluid may flow out from the drill bit 526 and be returned to the surface 504 through an annular area 540 between the drill pipe 518 and the sides of the borehole 512. The drilling fluid may then be returned to the mud pit 534, where such fluid may be filtered. In some embodiments, the drilling fluid may be used to cool the drill bit 526, as well as to provide lubrication for the drill bit 526 during drilling operations. Additionally, the drilling fluid may be used to remove subsurface formation 514 cuttings created by operating the drill bit 526. It may be the images of these cuttings that many implementations operate to acquire and process.

Figure 6:
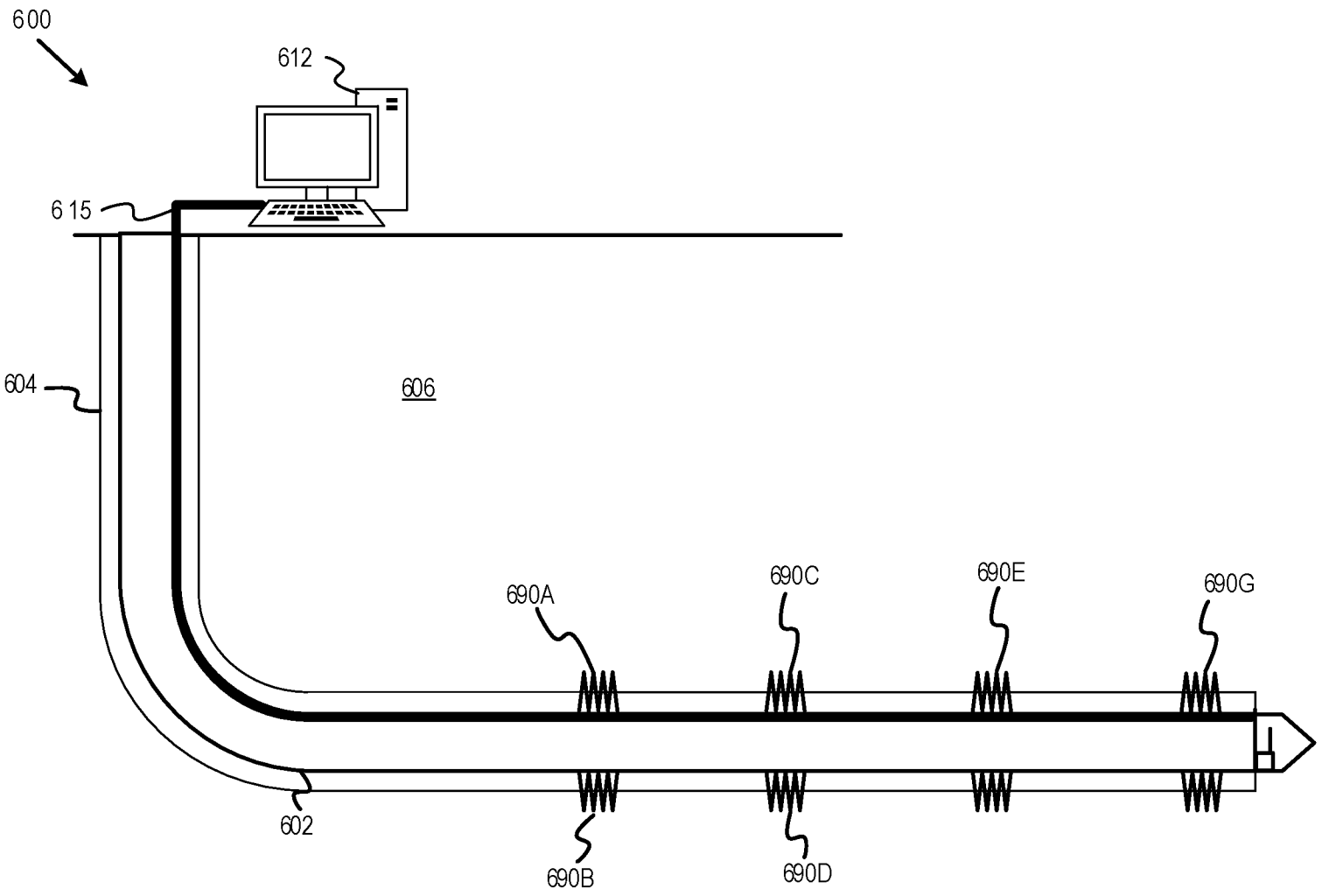
FIG. 6 is a schematic diagram of an example well system that includes fracturing operations that can provide real-time data to a data services platform, according to some implementations.

FIG. 6 is a schematic diagram of an example well system 600 that includes fracturing operations that can provide real-time data to a data services platform, according to some implementations. The well system 600 may comprise a wellbore 604 in a subsurface formation 606. The wellbore 604 may include a casing 602 and a number of perforations 690A-690G being made in the casing 602 at different depths as part of hydraulic fracturing to allow hydraulic communication between the subsurface formation 606 and the casing 602. The well system 600 also may include a computer system 612 that may be communicatively coupled to sensors, control devices, and other well devices downhole in order to monitor operations and detect downhole fault. The well system 600 may include a well electrical cable 615 that may provide power to the downhole sensors, control devices, and other well devices. The computer system 612 may provide real-time data from the sensors and control devices and other well devices to a data service platform that is implemented in a local edge network or a remote cloud server network, as described in FIGS. 1-4. The data service platform may provide alerts and other notifications or results data to the operator of the well system 600 or the computer system 612 that can cause modification of the well system operation or the maintenance of the well system 600.

It is noted, however, that the well systems described in FIGS. 1-4 may be any type of well system in the oil and gas industry, such as well systems that are used in oil and gas E&P operations. The well systems may be any time of drilling well systems, completion well systems, and producing well systems, including both naturally flowing or artificially lifted well systems.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for reservoir modeling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Example Embodiments can include the following:

Embodiments #1: A method for implementing a data services platform for real-time data obtained from well systems, comprising: receiving, by the data services platform, an input of a first data processing algorithm having a data processing function for processing real-time data from one or more well systems, the first data processing algorithm created using a template associated with the data services platform; integrating the first data processing algorithm into a framework of the data services platform, the framework providing a plurality of data management functions for managing the real-time data from the one or more well systems; receiving, by the data services platform, a configuration for the data processing function of the first data processing algorithm, the configuration including one or more parameters associated with the real-time data from at least a first well system of the one or more well systems; and configuring the framework that provides the plurality of data management functions with the one or more parameters.

Embodiments #2: The method of Embodiments #1, wherein integrating the first data processing algorithm into the framework of the data services platform includes: integrating the first data processing algorithm with a plurality of data management algorithms that provide the plurality of data management functions, the plurality of data management algorithms accessible by the first data processing algorithm during an execution of the first data processing algorithm and the processing of the real-time data from the first well system.

Embodiments #3: The method of Embodiments #2, wherein the plurality of data management algorithms include a plurality of prebuilt and reusable algorithms that are ancillary to the first data processing algorithm and perform the plurality of data management functions for the first data processing algorithm, the data management functions include at least one of: I/O data management functions, algorithm authentication functions, algorithm version management functions, algorithm test and evaluation functions, data visualization and analysis functions, and historical data replay functions.

Embodiments #4: The method of Embodiments #1, wherein one of the plurality of data management functions provided by the framework of the data services platform includes an input data management function for real-time data streams from a plurality of well systems, further comprising: deploying and enabling the first data processing algorithm that utilizes the framework of the data services platform to perform the plurality of data management functions; and monitoring the real-time data streams from the plurality of well systems to select the real-time data from the first well system having the one or more parameters for processing by the first data processing algorithm.

Embodiments #5: The method of Embodiments #4, wherein the plurality of data management functions provided by the framework of the data services platform include an output data management function and a data visualization and analysis function for managing output data from the first data processing algorithm, further comprising: detecting and storing the output data from the first data processing algorithm for storing historical data; and processing the output data for visualization and analysis of the output data.

Embodiments #6: The method of Embodiments #5, wherein processing the output data for visualization and analysis of the output data from the first data processing algorithm includes providing alerts or notifications regarding the first well system to cause modification of well system operations or maintenance of the first well system.

Embodiments #7: The method of Embodiments #1, wherein the plurality of data management functions provided by the framework of the data services platform include an output data management function and a historical data replay function, further comprising: detecting and storing the output data from the first data processing algorithm for storing historical data; receiving a request to replay historical data from a first time period; and replaying the historical data from the first time period in the data services platform as if the historical data is real-time data.

Embodiments #8: The method of Embodiments #1, wherein the one or more parameters included in the configuration for the first data processing algorithm includes at least one of: a well system identifier for the first well system; a sliding time window size for the real-time data; and one or more well system parameters from the first well system for processing using the first data processing algorithm, the one or more well system parameters being part of the real-time data from the first well system.

Embodiments #9: The method of Embodiments #1, wherein configuring the framework that provides the plurality of data management functions with the one or more parameters includes: configuring a plurality of data management algorithms that perform the plurality of data management functions with the one or more parameters specified by the configuration associated with the first data processing algorithm; and managing the real-time data from the first well system based on the one or more parameters.

Embodiments #10: The method of Embodiments #1, wherein the data services platform is implemented in a cloud server network that is remote from the first well system or in an edge network that is local to the first well system.

Embodiments #11: A non-transitory computer-readable medium including computer-executable instructions comprising: instructions for receiving, by a data services platform, an input of a first data processing algorithm having a data processing function for processing real-time data from one or more well systems, the first data processing algorithm created using a template associated with the data services platform; instructions for integrating the first data processing algorithm into a framework of the data services platform, the framework providing a plurality of data management functions for managing the real-time data from the one or more well systems; instructions for receiving, by the data services platform, a configuration for the data processing function of the first data processing algorithm, the configuration including one or more parameters associated with the real-time data from at least a first well system of the one or more well systems; and instructions for configuring the framework that provides the plurality of data management functions with the one or more parameters.

Embodiments #12: The non-transitory computer-readable medium of Embodiments #11, wherein the instructions for integrating the first data processing algorithm into the framework of the data services platform further include: instructions for integrating the first data processing algorithm with a plurality of data management algorithms that provide the plurality of data management functions, the plurality of data management algorithms accessible by the first data processing algorithm during an execution of the first data processing algorithm and the processing of the real-time data from the first well system.

Embodiments #13: The non-transitory computer-readable medium of Embodiments #12, wherein the plurality of data management algorithms include a plurality of prebuilt and reusable algorithms that are ancillary to the first data processing algorithm and perform the plurality of data management functions for the first data processing algorithm, the data management functions include at least one of: I/O data management functions, algorithm authentication functions, algorithm version management functions, algorithm test and evaluation functions, data visualization and analysis functions, and historical data replay functions.

Embodiments #14: The non-transitory computer-readable medium of Embodiments #11, wherein one of the plurality of data management functions provided by the framework of the data services platform includes an input data management function for real-time data streams from a plurality of well systems, and the instructions further include: instructions for deploying and enabling the first data processing algorithm that utilizes the framework of the data services platform to perform the plurality of data management functions; and instructions for monitoring the real-time data streams from the plurality of well systems to select the real-time data from the first well system having the one or more parameters for processing by the first data processing algorithm.

Embodiments #15: The non-transitory computer-readable medium of Embodiments #14, wherein the plurality of data management functions provided by the framework of the data services platform include an output data management function and a data visualization and analysis function for managing output data from the first data processing algorithm, and the instructions further include: instructions for detecting and storing the output data from the first data processing algorithm for storing historical data; and instructions for processing the output data for visualization and analysis of the output data.

Embodiments #16: The non-transitory computer-readable medium of Embodiments #11, wherein the plurality of data management functions provided by the framework of the data services platform include an output data management function and a historical data replay function, and the instructions further include: instructions for detecting and storing the output data from the first data processing algorithm for storing historical data; instructions for receiving a request to replay historical data from a first time period; and instructions for replaying the historical data from the first time period in the data services platform as if the historical data is real-time data.

Embodiments #17: A system for implementing a data services platform for real-time data obtained from well systems, comprising: one or more processors; and a computer-readable medium having instructions stored therein, the instructions executable by the one or more processors to cause the system to: receive an input of a first data processing algorithm having a data processing function for processing real-time data from one or more well systems, the first data processing algorithm created using a template associated with the data services platform; integrate the first data processing algorithm into a framework of the data services platform, the framework providing a plurality of data management functions for managing the real-time data from the one or more well systems; receive a configuration for the data processing function of the first data processing algorithm, the configuration including one or more parameters associated with the real-time data from at least a first well system of the one or more well systems; and configure the framework that provides the plurality of data management functions with the one or more parameters.

Embodiments #18: The system of Embodiments #17, wherein the instructions are executable by the one or more processors to cause the system to: integrate the first data processing algorithm with a plurality of data management algorithms that provide the plurality of data management functions, the plurality of data management algorithms accessible by the first data processing algorithm during an execution of the first data processing algorithm and the processing of the real-time data from the first well system.

Embodiments #19: The system of Embodiments #17, wherein one of the plurality of data management functions provided by the framework of the data services platform includes an input data management function for real-time data streams from a plurality of well systems, and the instructions are executable by the one or more processors to cause the system to: deploy and enable the first data processing algorithm that utilizes the framework of the data services platform to perform the plurality of data management functions; and monitor the real-time data streams from the plurality of well systems to select the real-time data from the first well system having the one or more parameters for processing by the first data processing algorithm.

Embodiments #20: The system of Embodiments #19, wherein the plurality of data management functions provided by the framework of the data services platform include an output data management function and a data visualization and analysis function for managing output data from the first data processing algorithm, and the instructions are executable by the one or more processors to cause the system to: detect and store the output data from the first data processing algorithm for storing historical data; and process the output data for visualization and analysis of the output data.

What is claimed is:

1. A method for implementing a data services platform for real-time data obtained from well systems, comprising:

receiving, by the data services platform, an input of a first data processing algorithm having a data processing function for processing real-time data from one or more well systems, the first data processing algorithm created using a template associated with the data services platform;

integrating, by the data services platform, the first data processing algorithm into a framework of the data services platform, the framework having a plurality of reusable data management algorithms that provide a plurality of data management functions for managing the real-time data from the one or more well systems;

receiving, by the data services platform, a configuration for the data processing function of the first data processing algorithm, the configuration including one or more parameters associated with the real-time data from at least a first well system of the one or more well systems;

configuring, by the data services platform, the plurality of reusable data management algorithms that perform the plurality of data management functions with the one or more parameters specified by the configuration associated with the first data processing algorithm; and managing, by the data services platform, the real-time data from the first well system based on the one or more parameters.

2. The method of claim 1, wherein integrating the first data processing algorithm into the framework of the data services platform includes:

integrating the first data processing algorithm with the plurality of reusable data management algorithms that provide the plurality of data management functions, the plurality of reusable data management algorithms accessible by the first data processing algorithm during an execution of the first data processing algorithm and the processing of the real-time data from the first well system.

3. The method of claim 2, wherein the plurality of reusable data management algorithms include a plurality of prebuilt and reusable algorithms that are ancillary to the first data processing algorithm and perform the plurality of data management functions for the first data processing algorithm, the data management functions include at least one of:

input and output (I/O) data management functions, algorithm authentication functions, algorithm version management functions, algorithm test and evaluation functions, data visualization and analysis functions, and historical data replay functions.

4. The method of claim 1, wherein one of the plurality of data management functions provided by the framework of the data services platform includes an input data management function for real-time data streams from a plurality of well systems, further comprising:

deploying and enabling the first data processing algorithm that utilizes the framework of the data services platform to perform the plurality of data management functions; and monitoring the real-time data streams from the plurality of well systems to select the real-time data from the first well system having the one or more parameters for processing by the first data processing algorithm.

5. The method of claim 4, wherein the plurality of data management functions provided by the framework of the data services platform include an output data management function and a data visualization and analysis function for managing output data from the first data processing algorithm, further comprising:

detecting and storing the output data from the first data processing algorithm for storing historical data; and processing the output data for visualization and analysis of the output data.

6. The method of claim 5, wherein processing the output data for visualization and analysis of the output data from the first data processing algorithm includes providing alerts or notifications regarding the first well system to cause modification of well system operations or maintenance of the first well system.

7. The method of claim 1, wherein the plurality of data management functions provided by the framework of the data services platform include an output data management function and a historical data replay function, further comprising:

detecting and storing the output data from the first data processing algorithm for storing historical data;

receiving a request to replay historical data from a first time period; and replaying the historical data from the first time period in the data services platform as if the historical data is real-time data.

8. The method of claim 1, wherein the one or more parameters included in the configuration for the first data processing algorithm includes at least one of:

a well system identifier for the first well system;

a sliding time window size for the real-time data; and one or more well system parameters from the first well system for processing using the first data processing algorithm, the one or more well system parameters being part of the real-time data from the first well system.

9. The method of claim 1, wherein the data services platform is implemented in a cloud server network that is remote from the first well system or in an edge network that is local to the first well system.

10. A non-transitory computer-readable medium including computer-executable instructions comprising:

instructions for receiving, by a data services platform, an input of a first data processing algorithm having a data processing function for processing real-time data from one or more well systems, the first data processing algorithm created using a template associated with the data services platform;

instructions for integrating, by the data services platform, the first data processing algorithm into a framework of the data services platform, the framework having a plurality of reusable data management algorithms that provide a plurality of data management functions for managing the real-time data from the one or more well systems;

instructions for receiving, by the data services platform, a configuration for the data processing function of the first data processing algorithm, the configuration including one or more parameters associated with the real-time data from at least a first well system of the one or more well systems; and instructions for configuring, by the data services platform, the plurality of reusable data management algorithms that perform the plurality of data management functions with the one or more parameters specified by the configuration associated with the first data processing algorithm; and instructions for managing, by the data services platform, the real-time data from the first well system based on the one or more parameters.

11. The non-transitory computer-readable medium of claim 10, wherein the plurality of data management functions provided by the framework of the data services platform include an output data management function and a historical data replay function, and the instructions further include:

instructions for detecting and storing the output data from the first data processing algorithm for storing historical data;

instructions for receiving a request to replay historical data from a first time period; and instructions for replaying the historical data from the first time period in the data services platform as if the historical data is real-time data.

12. The non-transitory computer-readable medium of claim 10, wherein the instructions for integrating the first data processing algorithm into the framework of the data services platform further include:

instructions for integrating the first data processing algorithm with the plurality of reusable data management algorithms that provide the plurality of data management functions, the plurality of reusable data management algorithms accessible by the first data processing algorithm during an execution of the first data processing algorithm and the processing of the real-time data from the first well system.

13. The non-transitory computer-readable medium of claim 12, wherein the plurality of reusable data management algorithms include a plurality of prebuilt and reusable algorithms that are ancillary to the first data processing algorithm and perform the plurality of data management functions for the first data processing algorithm, the data management functions include at least one of:

input and output (I/O) data management functions,
algorithm authentication functions,
algorithm version management functions,
algorithm test and evaluation functions,
data visualization and analysis functions, and
historical data replay functions.

14. The non-transitory computer-readable medium of claim 10, wherein one of the plurality of data management functions provided by the framework of the data services platform includes an input data management function for real-time data streams from a plurality of well systems, and the instructions further include:

instructions for deploying and enabling the first data processing algorithm that utilizes the framework of the data services platform to perform the plurality of data management functions; and instructions for monitoring the real-time data streams from the plurality of well systems to select the real-time data from the first well system having the one or more parameters for processing by the first data processing algorithm.

15. The non-transitory computer-readable medium of claim 14, wherein the plurality of data management functions provided by the framework of the data services platform include an output data management function and a data visualization and analysis function for managing output data from the first data processing algorithm, and the instructions further include:

instructions for detecting and storing the output data from the first data processing algorithm for storing historical data; and instructions for processing the output data for visualization and analysis of the output data.

16. A system for implementing a data services platform for real-time data obtained from well systems, comprising:

one or more processors; and a computer-readable medium having instructions stored therein, the instructions executable by the one or more processors to cause the data services platform of the system to:

receive an input of a first data processing algorithm having a data processing function for processing real-time data from one or more well systems, the first data processing algorithm created using a template associated with the data services platform;

integrate the first data processing algorithm into a framework of the data services platform, the framework having a plurality of reusable data management algorithms that provide a plurality of data management functions for managing the real-time data from the one or more well systems;

receive a configuration for the data processing function of the first data processing algorithm, the configuration including one or more parameters associated with the real-time data from at least a first well system of the one or more well systems; and configure the plurality of reusable data management algorithms that perform the plurality of data management functions with the one or more parameters specified by the configuration associated with the first data processing algorithm; and manage the real-time data from the first well system based on the one or more parameters.

17. The system of claim 16, wherein the instructions are executable by the one or more processors to cause the system to:

integrate the first data processing algorithm with the plurality of reusable data management algorithms that provide the plurality of data management functions, the plurality of reusable data management algorithms accessible by the first data processing algorithm during an execution of the first data processing algorithm and the processing of the real-time data from the first well system.

18. The system of claim 16, wherein one of the plurality of data management functions provided by the framework of the data services platform includes an input data management function for real-time data streams from a plurality of well systems, and the instructions are executable by the one or more processors to cause the system to:

deploy and enable the first data processing algorithm that utilizes the framework of the data services platform to perform the plurality of data management functions; and monitor the real-time data streams from the plurality of well systems to select the real-time data from the first well system having the one or more parameters for processing by the first data processing algorithm.

19. The system of claim 18, wherein the plurality of data management functions provided by the framework of the data services platform include an output data management function and a data visualization and analysis function for managing output data from the first data processing algorithm, and the instructions are executable by the one or more processors to cause the system to:

detect and store the output data from the first data processing algorithm for storing historical data; and process the output data for visualization and analysis of the output data.

* * * * *